US005763127A

United States Patent [19]

Goshima et al.

[11] Patent Number: 5,763,127

[45] Date of Patent: Jun. 9, 1998

[54] ELECTROPHOTOGRAPHIC PHOTORECEPTOR

[75] Inventors: Koji Goshima; Ichiro Takegawa, both of Minami-ashigara, Japan

[73] Assignee: Fuji Xerox Co., Ltd., Tokyo, Japan

[21] Appl. No.: 684,848

[22] Filed: Jul. 25, 1996

[30] Foreign Application Priority Data

Jul. 28, 1995 [JP] Japan ..... 7-211435

[51] Int. Cl.[6] ..... G03G 5/14

[52] U.S. Cl. ..... 430/62; 430/63; 430/64; 430/65

[58] Field of Search ..... 430/62, 63, 64, 430/65

[56] References Cited

U.S. PATENT DOCUMENTS 4,692,392 9/1987 Ichimura et al. ..... 430/62
5,391,448 2/1995 Katayama et al. ..... 430/65

FOREIGN PATENT DOCUMENTS

A-50-152733 12/1975 Japan .
A-57-81269 5/1982 Japan .
A-5-333581 12/1993 Japan .

OTHER PUBLICATIONS

Chemical Abstracts 121:69490, Dec. 1993.

*Primary Examiner*—Christopher D. Rodee
*Attorney, Agent, or Firm*—Oliff & Berridge, PLC

[57] ABSTRACT

An electrophotographic photoreceptor is disclosed which comprises an electroconductive support, a first interlayer formed on the support and containing low-resistance electroconductive particles having a specific resistance of from $10^{0}$ to $10^{4}$ Ωcm, a second interlayer formed on the first interlayer and containing high-resistance electroconductive particles having a specific resistance of from $10^{4}$ to $10^{8}$ Ωcm, and a photosensitive layer formed on the second interlayer. In the electrophotographic photoreceptor, in which the interlayers have an increased thickness for hiding defects present on the support and contain electroconductive particles dispersed therein, the photosensitive layer is free from the electrification performance decrease caused by charge injection thereinto and the interlayers have excellent leak-preventive properties.

12 Claims, 1 Drawing Sheet

ELECTROPHOTOGRAPHIC PHOTORECEPTOR

FIELD OF THE INVENTION

The present invention relates to an electrophotographic photoreceptor having interlayers each containing electroconductive particles.

BACKGROUND OF THE INVENTION

Photoreceptors comprising an electroconductive support made of, e.g., aluminum or an aluminum alloy and formed thereon a photosensitive layer containing a photoconductive material have been known as electrophotographic photoreceptors for use in electrophotographic copiers, laser printers, LED printers, and the like.

In the above kind of electrophotographic photoreceptors, an interlayer (undercoat layer) is frequently formed between the electroconductive support and the photosensitive layer for the purposes of diminishing image defects caused by pinhole leaks, hiding defects present on the support surface, improving electrification characteristics, inhibiting the injection of unnecessary charges from the support, improving support/photosensitive layer adhesion, improving applicability in coating, etc.

Especially for preventing pinhole leaks caused by the contact of an electrophotographic photoreceptor with a voltage-applied charging roll, it is necessary to form an interlayer which not only is made of a material having leak-preventive properties but also has a thickness larger than the size of the defects which are present on the support surface and apt to cause pinhole leaks so that the defects are hidden by the interlayer. In this case, it is also necessary to prevent the accumulation of residual charges because of the increased interlayer thickness.

A known technique for satisfying these requirements is to form an interlayer which has an increased thickness and contains electroconductive particles dispersed therein to thereby have reduced resistance. Known electroconductive particulate materials which can be used in that interlayer include carbon black, as described in JP-A-50-152733 (the term "JP-A" as used herein means an "unexamined published Japanese patent application"), and the electroconductive metal oxide particles described in JP-A-57-81269. The interlayers containing these electroconductive particles are also called electroconductive layers. By using an interlayer containing such electroconductive particles dispersed therein, the occurrence of pinhole leaks and the increase in residual potential can be mitigated to some degree.

However, the conventional electrophotographic photoreceptors having an interlayer containing electroconductive particles dispersed therein have a problem that since electroconductive particles have the property of injecting charges into a photosensitive layer, formation of a photosensitive layer directly on the interlayer (electroconductive layer) results in impaired electrification performance of the photosensitive layer.

SUMMARY OF THE INVENTION

The present invention has been achieved in order to eliminate the above-described problem of the conventional technique.

An object of the present invention is to provide an electrophotographic photoreceptor which comprises an electroconductive support, a photosensitive layer, and an interlayer therebetween having an increased thickness for hiding defects present on the support and containing electroconductive particles dispersed therein, and in which the photosensitive layer is free from the electrification performance decrease caused by charge injection thereinto and the interlayer has excellent leak-preventive properties.

As a result of intensive investigations made by the present inventors, it has been found that an electrophotographic photoreceptor comprising an electroconductive support, a photosensitive layer, and two interlayers disposed between the support and the photosensitive layer and each containing specific electroconductive particles does not cause the image defects attributable to, e.g., pinhole leaks resulting from contact with a voltage-applied charging roll, is free from charge injection from the electroconductive layers into the photosensitive layer to thereby prevent the photosensitive layer from suffering a decrease in electrification performance, and is hence capable of giving clear images. The present invention has been completed based on this finding.

The electrophotographic photoreceptor of the present invention comprises an electroconductive support, a first interlayer formed on the support and containing low-resistance electroconductive particles having a specific resistance (resistivity) of from $10^0$ to $10^4$ Ωcm, a second interlayer formed on the first interlayer and containing high-resistance electroconductive particles having a specific resistance of from $10^4$ to $10^8$ Ωcm, and a photosensitive layer formed on the second interlayer.

BRIEF DESCRIPTION OF THE DRAWING

FIGURE is a schematic sectional view illustrating one embodiment of the electrophotographic photoreceptor of the present invention.

DETAILED DESCRIPTION OF THE INVENTION

Figure 1:
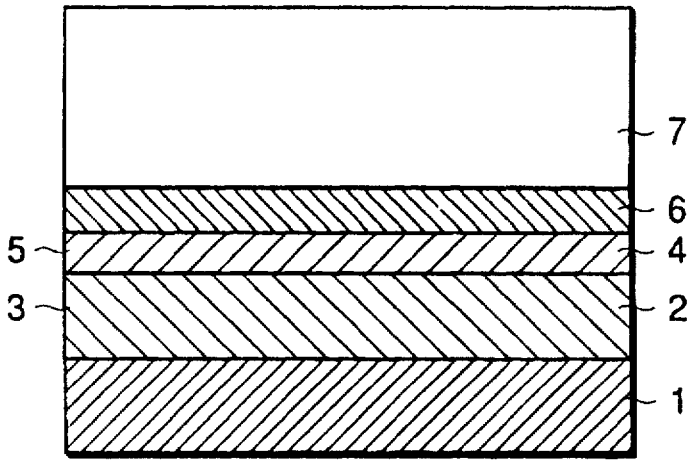

FIGURE is a schematic sectional view of one embodiment of the electrophotographic photoreceptor of the present invention. The electrophotographic photoreceptor of the invention is explained by reference to FIGURE. This electrophotographic photoreceptor comprises an electroconductive support 1, a first interlayer 2 formed on the support 1 and containing low-resistance electroconductive particles 3, a second interlayer 4 formed on the first interlayer 2 and containing high-resistance electroconductive particles 5, a charge-generating layer 6 formed on the second interlayer 4, and a charge-transporting layer 7 formed on the charge-generating layer 6.

A conventionally known electroconductive support made of, e.g., aluminum or an aluminum alloy may be used as the electroconductive support 1.

In the present invention, the first interlayer 2 is formed by applying a coating fluid comprising an appropriate binder resin and dispersed therein low-resistance electroconductive particles 3 having a specific resistance of from $10^0$ to $10^4$ Ωcm, while the second interlayer 4 is formed by applying a coating fluid comprising an appropriate binder resin and dispersed therein high-resistance electroconductive particles 5 having a specific resistance of from $10^4$ to $10^8$ Ωcm. If desired and necessary, an undercoat layer may be formed on the second interlayer. The charge-generating layer 6 and the charge-transporting layer 7 comprise a charge-generating substance and a charge-transporting substance, respectively, which are dispersed in a binder resin. The layers 6 and 7 constitute a photosensitive layer.

The first interlayer in the present invention functions as a covering layer for hiding defects, e.g., mars, present on the surface of the electroconductive support. In order for the overlying photosensitive layer to have a reduced residual potential, the first interlayer should contain low-resistance electroconductive particles having a specific resistance of from $10^0$ to $10^4$ Ωcm, preferably from $10^0$ to $10^3$ Ωcm.

Examples of the low-resistance electroconductive particles having a specific resistance of from $10^0$ to $10^4$ Ωcm for use in the first interlayer include $Fe_2O_3$; carbon black; particles of various metal oxides such as, e.g., antimony oxide-doped $SnO_2$, $In_2O_3$, $TiO_2/SnO_2$, and fluoromica/$SnO_2$; particles of Al-doped ZnO, CuS/ZnS, CdO, and AgO; and particles of AgO doped with a slight amount of Pb, Sn, and Hg. These low-resistance electroconductive particles have an average particle diameter of from 0.005 to 5.0 μm, preferably from 0.01 to 1.0 μm.

Any resin can be used as the binder resin for dispersing the low-resistance electroconductive particles therein, as long as the resin used satisfies requirements including (1) it tenaciously adheres to the electroconductive support 1, (2) the particles show satisfactory dispersibility therein, and (3) it has sufficient solvent resistance. Examples of the binder resin include curable rubbers, polyurethane resins, epoxy resins, alkyd resins, polyester resins, silicone resins, acrylic-melamine resins, phenolic resins, poly(vinyl alcohol), polyvinylpyrrolidone, polyvinylpyridine, cellulose ethers, cellulose esters, polyamides, polyurethanes, casein, gelatin, poly(glutamic acid), starch acetate, aminostarch, polyacrylic resins, and polyacrylamide resins.

In forming the first interlayer, the binder resin may be used in combination with an organometallic compound and/or a silane coupling agent in order to enhance adhesion to the electroconductive support and solvent resistance. Representative examples of the organometallic compound include zirconium chelate compounds, zirconium alkoxides, orthotitanic esters, poly(orthotitanic ester)s, and titanium chelates.

The first interlayer, comprising the low-resistance electroconductive particles and binder resin described above, preferably has a volume resistivity of from $10^0$ to $10^4$ Ωcm, more preferably from $10^0$ to $10^3$ Ωcm, and preferably has a layer thickness of from 1 to 25 μm, more preferably from 3 to 20 μm.

The incorporation amount of the low-resistance electroconductive particles dispersed in the binder resin contained in the first interlayer is from 0.05 to 9.0 parts by weight, preferably from 1.0 to 3.0 parts by weight, per part by weight of the binder resin.

In the present invention, the second interlayer 4 is formed on the first interlayer. This second interlayer functions to inhibit charge injection from the first interlayer.

Examples of the high-resistance electroconductive particles 5 having a specific resistance of from $10^4$ to $10^8$ Ωcm (preferably from $10^5$ to $10^8$ Ωcm) for use in the second interlayer include $SnO_2$, $TiO_2$ in untreated anatase form, untreated rutile form, and rutile form (treated with Al), $WO_3$, $V_2O_5$, SiC, $Pe_2O_3$, $Li^+$-doped ZnO, and $Ag_2O$. These high-resistance electroconductive particles have an average particle diameter of from 0.005 to 5.0 μm, preferably from 0.01 to 1.0 μm. Examples of the binder resin for dispersing the high-resistance electroconductive particles therein include the same resins enumerated hereinabove as examples of the binder resin for use in the first interlayer.

The second interlayer, comprising the high-resistance electroconductive particles and binder resin described above, preferably has a volume resistivity of from $10^4$ to $10^8$ Ωcm, more preferably from $10^5$ to $10^8$ Ωcm, and preferably has a layer thickness of from 0.5 to 3.0 μm, more preferably from 1.0 to 2.0 μm.

The incorporation amount of the high-resistance electroconductive particles dispersed in the binder resin contained in the second interlayer is from 0.05 to 9.0 parts by weight, preferably from 1.0 to 3.0 parts by weight, per part by weight of the binder resin, as in the first interlayer.

In the electrophotographic photoreceptor of the present invention, a photosensitive layer is formed on the second interlayer. This photosensitive layer may have a single- or multilayer structure. The single-layer photosensitive layer comprises a charge-generating substance, e.g., a phthalocyanine or a squarylium compound, dispersed in a binder resin, if desired together with a charge-transporting substance. An example of the multilayered photosensitive layer include a multilayer structure in which functions are allotted to a charge-generating layer and a charge-transporting layer. This charge-generating layer comprises a charge-generating substance optionally dispersed in a binder resin.

Examples of the charge-generating substance include selenium and selenium alloys; inorganic photoconductive substances such as CdS, CdSe, CdSSe, and ZnO; metal or metal-free phthalocyanine pigments; azo pigments such as bis-azo pigments and tris-azo pigments; sguarylium compounds; azulenium compounds; perylene pigments; indigo pigments; and polycyclic quinone pigments. Known resins may be used as the binder resin, such as, e.g., polycarbonates, polystyrene, polyesters, poly(vinyl butyral), methacrylic ester polymers or copolymers, vinyl acetate polymer or copolymers, cellulose esters or ethers, polybutadiene, polyurethanes, and epoxy resins.

A charge-transporting layer is formed on the charge-generating layer. The charge-transporting layer comprises a charge-transporting substance as the main component. The charge-transporting substance is not particularly limited as long as it transmits visible light and has the ability to transport charges. Examples of the charge-transporting substance include imidazole, pyrazoline, thiazole, oxadiazole, oxazole, hydrazones, ketazines, azines, carbazole, polyvinylcarbazole, derivatives of these compounds, triphenylamine derivatives, stilbene derivatives, and benzidine derivatives. A binder resin may be used together with the charge-transporting substance if desired. Examples of the binder resin include polycarbonates, polyarylates, polyesters, polystyrene, styrene-acrylonitrile copolymers, polysulfones, poly(methacrylic ester)s, and styrene-methacrylic ester copolymers.

According to the present invention, by forming the first interlayer on an electroconductive support, the defects remaining on the support surface can be completely hidden. Since this layer contains dispersed therein electroconductive particles having a specific resistance of from $10^0$ to $10^4$ Ωcm, it can have a thickness as large as about from 1 to 25 μm without undergoing accumulation of residual charges therein and hence has a high hiding effect.

Moreover, due to the electroconductive particles having a specific resistance of from $10^4$ to $10^8$ Ωcm dispersed in the second interlayer formed on the first interlayer, the second interlayer functions as a barrier layer to not only inhibit charge injection from the first interlayer but also prevent the occurrence of pinhole leaks caused by contact with a voltage-applied charging roll.

The present invention will be explained below in detail by reference to Examples, but the scope of the invention should not be construed as being limited to these Examples unless the invention departs from its spirit. In the following description, all parts are by weight.

EXAMPLE 1

The surface of an aluminum tube having dimensions of $\phi 30 \times 254$ mm obtained through extrusion and subsequent cold drawing was roughened by wet honing to an $R_a$ of 0.20 μm, and then cleaned with an aqueous solvent solution to prepare an electroconductive support. To a solution of 42.8 parts of a curable acrylic resin (trade name, SA246; manufactured by Sanyo Chemical Industries, Ltd., Japan; solid content, 50%) in 30.3 parts of xylene solvent was added 30.5 parts of an antimony oxide-doped tin oxide ($SnO_2$) powder (trade name, T-1; manufactured by Mitsubishi Material Co., Ltd., Japan; specific resistance, 1–3 Ωcm; particle diameter, 0.02 μm). This mixture was treated with a ball mill for 20 hours to obtain a dispersion.

To the dispersion obtained was added 12.0 parts of xylene solvent. This dispersion was applied to the electroconductive support by dip coating, and the resin applied was heat-cured at 170° C. for 1 hour to form a first interlayer having a thickness of 10 μm. The first interlayer had a volume resistivity of 1 to 3 Ωcm.

To a solution of 42.8 parts of the same curable acrylic resin as that used for the first interlayer in 30.3 parts of xylene solvent was added 31.9 parts of a tin oxide ($SnO_2$) powder (trade name, S-1; manufactured by Mitsubishi Material Co., Ltd.; specific resistance, $10^6$–$10^8$ Ωcm; particle diameter, 0.02 μm). This mixture was treated with a ball mill for 20 hours to obtain a dispersion.

To the dispersion obtained was added 12.0 parts of xylene solvent. This dispersion was applied to the first interlayer by dip coating, and the resin applied was heat-cured at 170° C. for 1 hour to form a second interlayer having a thickness of 2.0 μm. The second interlayer had a volume resistance of $10^6$–$10^8$ Ωcm. Subsequently, a mixture of the following ingredients:

| | |
|---|---|
| X-form metal-free phthalocyanine | 5 parts |
| Vinyl chloride-vinyl acetate copolymer (VMCH, manufactured by Union Carbide Corp.) | 5 parts |
| n-Butyl acetate | 200 parts |

was treated for 2 hours with a sand mill employing 1-mmϕ glass beads. The dispersion thus obtained was applied to the second interlayer by dip coating and dried at 100° C. for 10 minutes to form a charge-generating layer having a thickness of 0.2 μm. Further, a solution consisting of:

Structural formula (1) 1 part

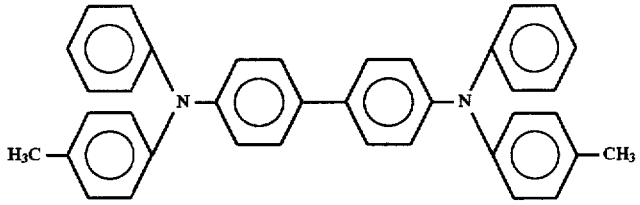

Structural formula (2) 1 part

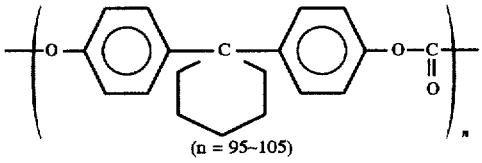

and

Monochlorobenzene 6 parts was applied to the charge-generating layer by dip coating and dried at 135° C. for 1 hour to form a charge-transporting layer having a thickness of 20 μm. Thus, an electrophotographic photoreceptor was produced.

EXAMPLE 2

An electroconductive support was prepared in the same manner as in Example 1. To a solution of 42.8 parts of a curable acrylic resin (SA246) in 30.3 parts of xylene solvent was added 30.5 parts of a tin oxide-doped $In_2O_3$ powder (trade name, ITO; manufactured by Mitsubishi Material Co., Ltd.; specific resistance, 3–10 Ωcm; particle diameter, 0.03 μm). This mixture was treated with a ball mill for 20 hours to obtain a dispersion.

To the dispersion obtained was added 12.0 parts of xylene solvent. This dispersion was applied to the electroconductive support by dip coating, and the resin applied was heat-cured at 170° C. for 1 hour to form a first interlayer having a thickness of 10 μm. The first interlayer has a volume resistivity of 3 to 10 Ωcm.

To a solution of 42.8 parts of the same curable acrylic resin (SA246) as that used for the first interlayer in 30.3 parts of xylene solvent was added an aluminum-treated titanium oxide (trade name, KR-460; manufactured by Titan Kogyo K.K., Japan; specific resistance, $10^7$ Ωcm) in the same manner as in the formation of the first interlayer. This mixture was treated with a ball mill for 20 hours to obtain a dispersion.

To the dispersion obtained was added 12.0 parts of xylene solvent. This dispersion was applied to the first interlayer by dip coating, and the resin applied was heat-cured at 170° C. for 1 hour to form a second interlayer having a thickness of 2.0 μm. The second interlayer had a volume resistivity of $10^7$ Ωcm.

A photosensitive layer was then formed on the second interlayer in the same manner as in Example 1 to produce an electrophotographic photoreceptor.

EXAMPLE 2'

An electroconductive support was prepared in the same manner as in Example 1. To a solution of 20 parts of a curable acrylic resin (SA246) in 28 parts of xylene solvent was added 30.5 parts of a $Fe_2O_3$ powder (trade name, R516-L; manufactured by Titan Kogyo K.K.; specific resistance, $10^4$ Ωcm; particle diameter, 0.08×0.8 μm). This mixture was treated with a ball mill for 20 hours to obtain a dispersion.

To the dispersion obtained was added 10 parts of xylene solvent. This dispersion was applied to the electroconductive support by dip coating, and the resin applied was heat-cured at 170° C. for 1 hour to form a first interlayer having a thickness of 10 μm. The first interlayer had a volume resistivity of $10^4$ Ωcm.

To a solution of 42.8 parts of the same curable acrylic resin (SA246) as that used for the first interlayer in 30.3 parts of xylene solvent was added a $WO_3$ powder (manufactured by Nippon Tungsten Co., Ltd., Japan; specific resistance, $10^4$–$10^5$ Ωcm; particle diameter, 0.3–0.6 μm) in the same manner as in the formation of the first interlayer. This mixture was treated with a ball mill for 320 hours to obtain a dispersion.

To the dispersion obtained was added 12.0 parts of xylene solvent. This dispersion was applied to the first interlayer by dip coating, and the resin applied was heat-cured at 170° C. for 1 hour to form a second interlayer having a thickness of 2.0 μm. The second interlayer had a volume resistivity of $10^4$–$10^3$.

A photosensitive layer was then formed on the second interlayer in the same manner as in Example 1 to produce an electrophotographic photoreceptor.

EXAMPLE 3

An electrophotographic photoreceptor was produced in the same manner as in Example 1, except that an undercoat layer having a thickness of 0.9 μm was formed on the second interlayer by applying a solution consisting of

| | |
|---|---|
| Acetylacetonatozirconium butoxide (Orgatics ZC540, manufactured by Matsumoto Trading Co., Ltd., Japan) | 20 parts |
| γ-Aminopropyltriethoxysilane (A1100, manufactured by Nippon Unicar Co., Ltd., Japan) | 2 parts |
| Poly(vinyl butyral) resin (S-Lec BM-S, manufactured by Sekisui Chemical Co., Ltd., Japan) | 1.5 parts |
| n-Butyl alcohol | 70 parts |

to the second interlayer by dip coating and drying the applied solution at 150° C. for 10 minutes, before the photosensitive layer was formed on the undercoat layer.

COMPARATIVE EXAMPLE 1

An electrophotographic photoreceptor was produced in the same manner as in Example 1, except that the first interlayer was formed as the only interlayer, and that the thickness of the first interlayer was changed to 12 μm so as to avoid any evaluation difference caused by different interlayer thicknesses.

COMPARATIVE EXAMPLE 2

An electrophotographic photoreceptor was produced in the same manner as in Example 1, except that the second interlayer was formed as the only interlayer, and that the thickness of the second interlayer was changed to 12 μm so as to avoid any evaluation difference caused by different interlayer thicknesses.

COMPARATIVE EXAMPLE 3

An electrophotographic photoreceptor was produced in the same manner as in Example 1, except that the sequence of the formation of the first and second interlayers was reversed.

COMPARATIVE EXAMPLE 4

The same undercoat layer as in Example 3 was formed on the same electroconductive support as in Example 1. A charge-generating layer and a charge-transporting layer were formed on the undercoat layer in the same manner as in Example 1 to produce an electrophotographic photoreceptor.

The electrophotographic photoreceptors produced in the Examples 1 to 3 and Comparative Examples 1 to 4 given above were evaluated for performances as follows.

Each electrophotographic photoreceptor was mounted in commercial laser printer PR1000/4 (manufactured by NEC Corp., Japan) to conduct copying. The copies obtained were evaluated for image defects and image fogging.

Simultaneously with the above evaluation, an AC voltage having a frequency of 800 Hz and an amplitude of 600 V was superimposed on −500 V DC voltage to conduct 100-sheet printing in order to evaluate the electrification performance of the photoreceptor. After the printing operation, the photoreceptor was examined for VRP and dark decay.

The results of the above evaluations are shown in Table 1.

TABLE 1

| | Image defect caused by pinhole leak after 100,000-sheet printing | Image fogging | VRP after 100-sheet printing [−V] | Dark decay [−V] |
|---|---|---|---|---|
| Ex. 1 | no pinhole leak | no fogging | 30 | 25 |
| Ex. 2 | no pinhole leak | no fogging | 30 | 30 |
| Ex. 2' | no pinhole leak | no fogging | 40 | 25 |
| Ex. 3 | no pinhole leak | no fogging | 40 | 25 |
| Comp. Ex. 1 | pinhole leak occurred frequently | considerable fogging | 30 | 90 |
| Comp. Ex. 2 | no pinhole leak | no fogging | 200 | 10 |
| Comp. Ex. 3 | pinhole leak occurred | no fogging | 30 | 30 |

TABLE 1-continued

| | Image defect caused by pinhole leak after 100,000-sheet printing | Image fogging | VRP after 100-sheet printing [−V] | Dark decay [−V] |
|---|---|---|---|---|
| Comp. Ex. 4 | pinhole leak occurred | no fogging | 40 | 25 |

As apparent from Table 1, the electrophotographic photoreceptor of the present invention does not cause the image defects attributable to, e.g., pinhole leaks and is free from residual charge accumulation and charge injection from the electroconductive layer into the photosensitive layer to thereby prevent the photosensitive layer from suffering a decrease in electrification performance, due to the first interlayer formed on the electroconductive support surface and containing low-resistance electroconductive particles having a specific resistance of from $10^0$ to $10^4$ Ωcm and due to the second interlayer formed thereon which contains high-resistance electroconductive particles having a specific resistance of from $10^4$ to $10^8$ Ωcm and has a volume resistivity of from $10^4$ to $10^8$ Ωcm. Therefore, copying with this photoreceptor gives high-definition images.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising:

an electroconductive support;

a first interlayer formed on the electroconductive support, the first interlayer containing low resistance electroconductive particles having a specific resistance of from $10^0$ to $10^4$ Ωcm and wherein the first interlayer has a volume resistivity of from $10^0$ to $10^4$ Ωcm;

a second interlayer formed on the first interlayer, the second interlayer containing high-resistance electroconductive particles having a specific resistance of from $10^4$ to $10^8$ Ωcm and wherein the second interlayer has a volume resistivity of from $10^4$ to $10^8$ Ωcm; and a photosensitive layer formed on the second interlayer.

2. The electrophotographic photoreceptor as claimed in claim 1, wherein the first interlayer has a volume resistivity of from $10^0$ to $10^3$ Ωcm.

3. The electrophotographic photoreceptor as claimed in claim 1, wherein the second interlayer has a volume resistivity of from $10^5$ to $10^8$ Ωcm.

4. The electrophotographic photoreceptor as claimed in claim 1, wherein the first interlayer comprises a binder resin and the low-resistance electroconductive particles dispersed therein, the amount of the low-resistance electroconductive particles being from 0.05 to 9 times by weight the amount of the binder resin.

5. The electrophotographic photoreceptor as claimed in claim 1, wherein the second interlayer comprises a binder resin and the high-resistance electroconductive particles dispersed therein, the amount of the high-resistance electroconductive particles being from 0.05 to 9 times by weight the amount of the binder resin.

6. The electrophotographic photoreceptor of claim 1 wherein said low resistance particle is antimony oxide doped $SnO_2$, and wherein said high resistance particle is $SnO_2$.

7. The electrophotographic photoreceptor of claim 1 wherein said low resistance particle is tin oxide doped $In_2O_3$ and wherein said high resistance particle is aluminum treated titanium oxide.

8. The electrophotographic photoreceptor of claim 1 wherein said low resistance particle is $Fe_2O_3$ and wherein said high resistance particle $WO_3$.

9. The electrophotographic photoreceptor of claim 1 further comprising an undercoat layer between said second interlayer and said photosensitive layer.

10. The electrophotographic photoreceptor of claim 9 wherein said undercoat layer comprises acetylacetonatozirconium butoxide, gamma-aminopropyltriethoxysilane and poly(vinyl butyral) resin.

11. The electrophotographic photorecepetor of claim 10 wherein said undercoat is formed by applying a solution consisting of said acetylacetonatozirconium butoxide, said gamma-aminopropyltriethoxysilane, said poly(vinyl butyral) resin, and n-butyl alcohol to said second interlayer.

12. The electrophotographic photoreceptor of claim 11 wherein said solution consists of 20 parts of said acetylacetonatozirconium butoxide, 2 parts of said gamma-aminopropyltriethoxysilane, 1.5 parts of said poly(vinyl butyral) resin, and 70 parts of said n-butyl alcohol.

* * * * *